US010209651B2

(12) United States Patent
Satoh et al.

(10) Patent No.: US 10,209,651 B2
(45) Date of Patent: Feb. 19, 2019

(54) FIXING DEVICE INCLUDING CLEANING WEB, IMAGE FORMING APPARATUS, AND IMAGE FORMING METHOD INCLUDING STANDBY MODE CLEANING

(71) Applicants: Tsukasa Satoh, Kanagawa (JP); Kyohhei Okuno, Kanagawa (JP)

(72) Inventors: Tsukasa Satoh, Kanagawa (JP); Kyohhei Okuno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/698,720

(22) Filed: Sep. 8, 2017

(65) Prior Publication Data

US 2018/0095389 A1 Apr. 5, 2018

(30) Foreign Application Priority Data

Sep. 30, 2016 (JP) ..... 2016-193682
Oct. 21, 2016 (JP) ..... 2016-206913

(51) Int. Cl.
*G03G 15/20* (2006.01)

(52) U.S. Cl.
CPC ..... *G03G 15/2025* (2013.01); *G03G 15/2039* (2013.01); *G03G 15/206* (2013.01)

(58) Field of Classification Search
CPC ..... G03G 15/2075
(Continued)

(56) References Cited

U.S. PATENT DOCUMENTS 5,850,588 A * 12/1998 Yoshikawa ..... G03G 15/2025 399/327
8,532,529 B2 * 9/2013 Kageyama ..... G03G 15/20 399/122
(Continued)

FOREIGN PATENT DOCUMENTS

JP 2001-083830 3/2001
JP 2003091198 A * 3/2003
(Continued)

OTHER PUBLICATIONS

Machine translation into English of JP 2006-178305.*
Machine translation into English of JP 2004-302029.*

*Primary Examiner* — Walter L Lindsay, Jr.
*Assistant Examiner* — Arlene Heredia
(74) *Attorney, Agent, or Firm* — Harness, Dickey & Pierce, P.L.C.

(57) ABSTRACT

A fixing device includes a pressure rotator to press against a fixing rotator to form a fixing nip therebetween, through which a recording medium is conveyed. A cleaning web cleans one of the fixing rotator and the pressure rotator. A web driver displaces the cleaning web to change a contact portion of the cleaning web, which contacts the one of the fixing rotator and the pressure rotator. A controller performs a temperature maintenance and rotation control to heat and rotate the fixing rotator at a predetermined time when the fixing device is in a standby mode in which the recording medium is not conveyed through the fixing nip. The controller controls the web driver at a predetermined time to perform a standby mode cleaning control to change the contact portion of the cleaning web according to an implementation status of the temperature maintenance and rotation control.

19 Claims, 6 Drawing Sheets

(58) Field of Classification Search
USPC ..... 399/69
See application file for complete search history.

(56) References Cited

U.S. PATENT DOCUMENTS

| | | | | |
|---|---|---|---|---|
| 2006/0159479 | A1* | 7/2006 | Sugita | G03G 15/2025 399/69 |
| 2012/0121301 | A1* | 5/2012 | Shimoyama | G03G 15/2064 399/328 |
| 2012/0219335 | A1 | 8/2012 | Kubota | |
| 2014/0376977 | A1* | 12/2014 | Nabuurs | G03G 15/161 399/327 |

FOREIGN PATENT DOCUMENTS

| | | | |
|---|---|---|---|
| JP | 2004-302029 | | 10/2004 |
| JP | 2006178305 | A * | 7/2006 |
| JP | 2012-058356 | | 3/2012 |
| JP | 2012-177863 | | 9/2012 |

* cited by examiner

FIXING DEVICE INCLUDING CLEANING WEB, IMAGE FORMING APPARATUS, AND IMAGE FORMING METHOD INCLUDING STANDBY MODE CLEANING

CROSS-REFERENCE TO RELATED APPLICATIONS

This patent application is based on and claims priority pursuant to 35 U.S.C. § 119 to Japanese Patent Application Nos. 2016-193682, filed on Sep. 30, 2016, and 2016-206913, filed on Oct. 21, 2016, in the Japanese Patent Office, the entire disclosure of each of which is hereby incorporated by reference herein.

BACKGROUND

Technical Field

Exemplary aspects of the present disclosure relate to a fixing device, an image forming apparatus, and an image forming method, and more particularly, to a fixing device for fixing a toner image on a recording medium, an image forming apparatus incorporating the fixing device, and an image forming method for forming a toner image on a recording medium.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one embodiment, the fixing device includes a fixing rotator and a heater to heat the fixing rotator. A pressure rotator presses against the fixing rotator to form a fixing nip between the pressure rotator and the fixing rotator. A recording medium bearing a toner image is conveyed through the fixing nip. A cleaning web contacts and cleans one of the fixing rotator and the pressure rotator. A web driver displaces the cleaning web to change a contact portion of the cleaning web, which contacts the one of the fixing rotator and the pressure rotator. A fixing rotator driver drives and rotates the fixing rotator. A controller controls the heater and the fixing rotator driver to perform a temperature maintenance and rotation control to heat and rotate the fixing rotator at a predetermined time when the fixing device is in a standby mode in which the recording medium is not conveyed through the fixing nip. The controller controls the web driver at a predetermined time to perform a standby mode cleaning control to change the contact portion of the cleaning web according to an implementation status of the temperature maintenance and rotation control.

This specification further describes an improved image forming apparatus. In one embodiment, the image forming apparatus includes an image bearer to bear a toner image and a fixing device to fix the toner image on a recording medium. The fixing device includes a fixing rotator and a heater to heat the fixing rotator. A pressure rotator presses against the fixing rotator to form a fixing nip between the pressure rotator and the fixing rotator. The recording medium bearing the toner image is conveyed through the fixing nip. A cleaning web contacts and cleans one of the fixing rotator and the pressure rotator. A web driver displaces the cleaning web to change a contact portion of the cleaning web, which contacts the one of the fixing rotator and the pressure rotator. A fixing rotator driver drives and rotates the fixing rotator. A controller controls the heater and the fixing rotator driver to perform a temperature maintenance and rotation control to heat and rotate the fixing rotator at a predetermined time when the fixing device is in a standby mode in which the recording medium is not conveyed through the fixing nip. The controller controls the web driver at a predetermined time to perform a standby mode cleaning control to change the contact portion of the cleaning web according to an implementation status of the temperature maintenance and rotation control.

This specification further describes an improved image forming method. In one embodiment, the image forming method includes starting a temperature maintenance and rotation control to heat and rotate a fixing rotator in a standby mode in which a recording medium is not conveyed over the fixing rotator; determining that a cumulative value of a temperature maintenance and rotation is equal to a threshold or greater; performing a standby mode cleaning to drive a web driving motor for a predetermined time to reel up a cleaning web; and adding a value for a single operation of the standby mode cleaning to the cumulative value of the temperature maintenance and rotation.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
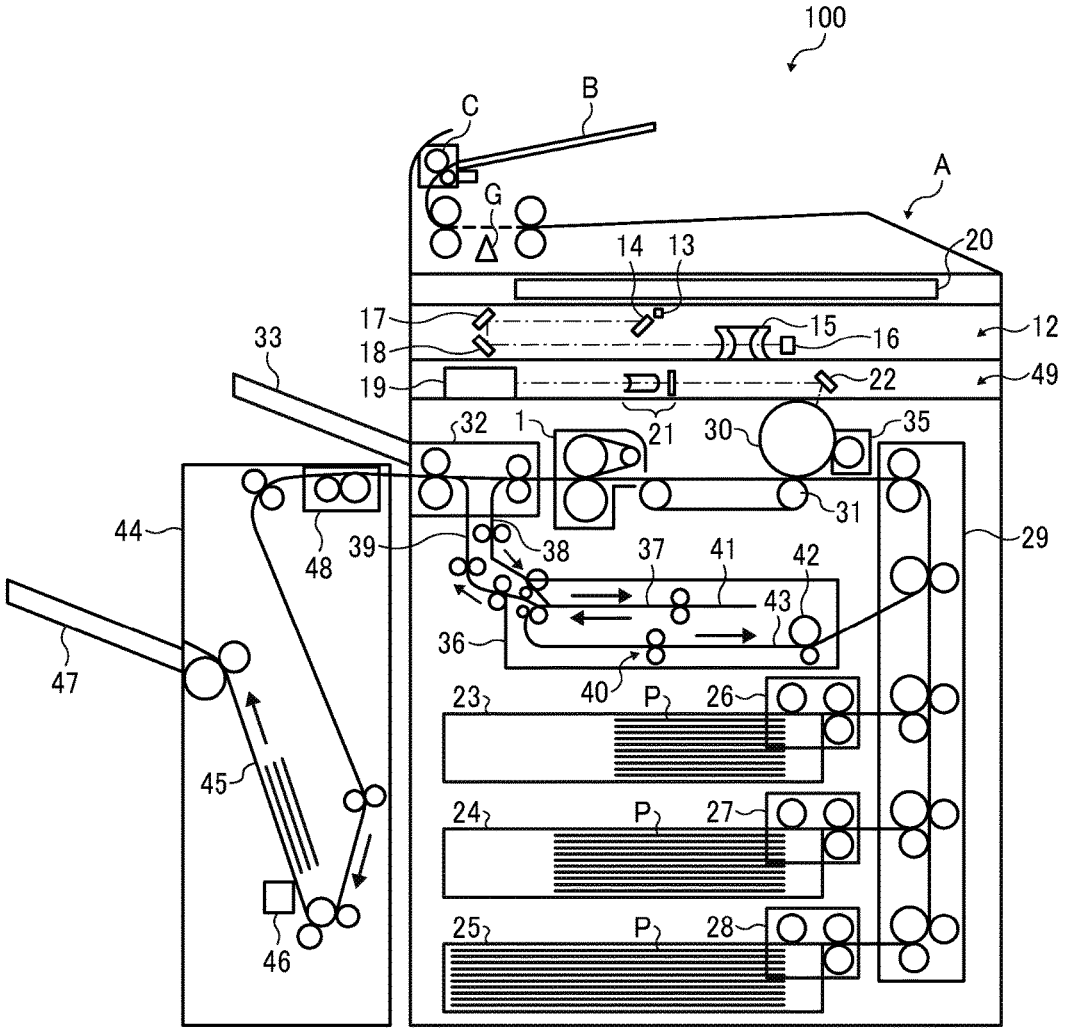
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 according to an embodiment is explained.

The image forming apparatus 100 may be a copier, a facsimile machine, a printer, a multifunction peripheral or a multifunction printer (MFP) having at least one of copying, printing, scanning, facsimile, and plotter functions, or the like. According to this embodiment, the image forming apparatus 100 is a monochrome copier that forms a monochrome toner image on a recording medium by electrophotography. Alternatively, the image forming apparatus 100 may be a color copier that forms a color toner image on a recording medium.

Referring to FIGS. 1 to 8, a detailed description is provided of configurations according to embodiments of the present disclosure.

Referring to FIG. 1, a description is provided of a construction of the image forming apparatus 100 according to an embodiment.

FIG. 1 is a schematic vertical cross-sectional view of the image forming apparatus 100.

As illustrated in FIG. 1, the image forming apparatus 100 includes a scanner unit 12 including an exposure glass 20 on which an original is placed and an optical scanning system. The scanner unit 12 scans the original placed on the exposure glass 20. The optical scanning system includes an exposure lamp 13, a first mirror 14, a second mirror 17, a third mirror 18, a lens 15, and a charge-coupled device (CCD) image sensor 16. The CCD image sensor 16 reads an image on the original into image data that is processed and converted into an electric signal.

An auto document feeder (ADF) A automatically feeds a plurality of originals one by one. The ADF A includes an original tray B, a feed roller C, and an original reading sensor G. The feed roller C feeds the original placed on the original tray B to the original reading sensor G. While the original conveyed at a constant speed passes through the original reading sensor G, the original reading sensor G reads the image on a front side of the original into image data. The image data is subject to image processing such as various processes including correction and compression. Thereafter, the image data is stored into an image memory successively.

A writing unit 49 includes a laser output unit 19, an image forming lens 21, and a mirror 22. The writing unit 49 emits a laser beam that irradiates a photoconductor 30, serving as an image bearer, of an image forming device.

A description is provided of a series of printing processes to print a toner image formed on the photoconductor 30 on a sheet P.

One of a first sheet feeder 26, a second sheet feeder 27, and a third sheet feeder 28 selectively feeds a sheet P from a corresponding one of a first tray 23, a second tray 24, and a third tray 25 each of which loads a plurality of sheets P. A vertical conveyance unit 29 conveys the sheet P to an upstream position disposed upstream from the photoconductor 30 in a sheet conveyance direction.

The writing unit 49 emits a laser beam onto the photoconductor 30 according to the image data stored in the image memory, thus writing an electrostatic latent image on the photoconductor 30. As the electrostatic latent image formed on the photoconductor 30 passes through a developing unit 35, the developing unit 35 develops the electrostatic latent image into a toner image. As a conveyance belt 31 conveys the sheet P at a conveyance speed identical to a rotation speed of the photoconductor 30 that bears the toner image, the toner image is transferred from the photoconductor 30 onto the sheet P. Thereafter, a fixing device 1 fixes the toner image on the sheet P. An ejection unit 32 ejects the sheet P onto an ejection tray 33.

If the image forming apparatus 100 receives a duplex print job to form a toner image on each of a front side and a back side of a sheet P, a reverse passage switch claw guides the sheet P bearing the toner image on the front side of the sheet P to a reverse passage. For example, the reverse passage switch claw guides the sheet P to a duplex entry conveyance path 38, not to the ejection tray 33. The sheet P is conveyed to a reverse unit 37 disposed inside a duplex conveyance unit 36 and is stored in a switchback conveyance path 41 temporarily. A return conveyor feeds the sheet P backward in a refeed direction. A reverse passage ejection switch claw guides the sheet P downward to a duplex intermediate conveyance path 43 disposed below the reverse passage ejection switch claw, thus reversing the sheet P. An intermediate conveyor 40 and a duplex exit conveyor 42 coupled to a driver (e.g., a motor) refeed the sheet P to the vertical conveyance unit 29. After a toner image is transferred from the photoconductor 30 onto the back side of the sheet P, the sheet P is ejected onto the ejection tray 33.

Alternatively, in order to reverse and eject the sheet P, the reverse passage ejection switch claw guides the sheet P reversed by switchback in the reverse unit 37 to a reverse ejection conveyance path 39, not to the duplex intermediate conveyance path 43. The sheet P returns to the ejection unit 32 that ejects the sheet P onto an outside of the image forming apparatus 100, that is, the ejection tray 33.

In order to eject the sheet P to the outside of the image forming apparatus 100, an ejection switch claw guides the sheet P to the ejection tray 33 attached to a body of the image forming apparatus 100 or a finisher 44. The sheet P ejected into the finisher 44 passes through a punch unit 48 that punches the sheet P. The sheet P is temporarily stacked in a stack tray 45 for stapling.

After a sheaf of sheets P used in a print job is stacked in the stack tray 45, a stapler unit 46 binds the sheaf of sheets P. The sheaf of sheets P is ejected onto an ejection tray 47.

Figure 2:
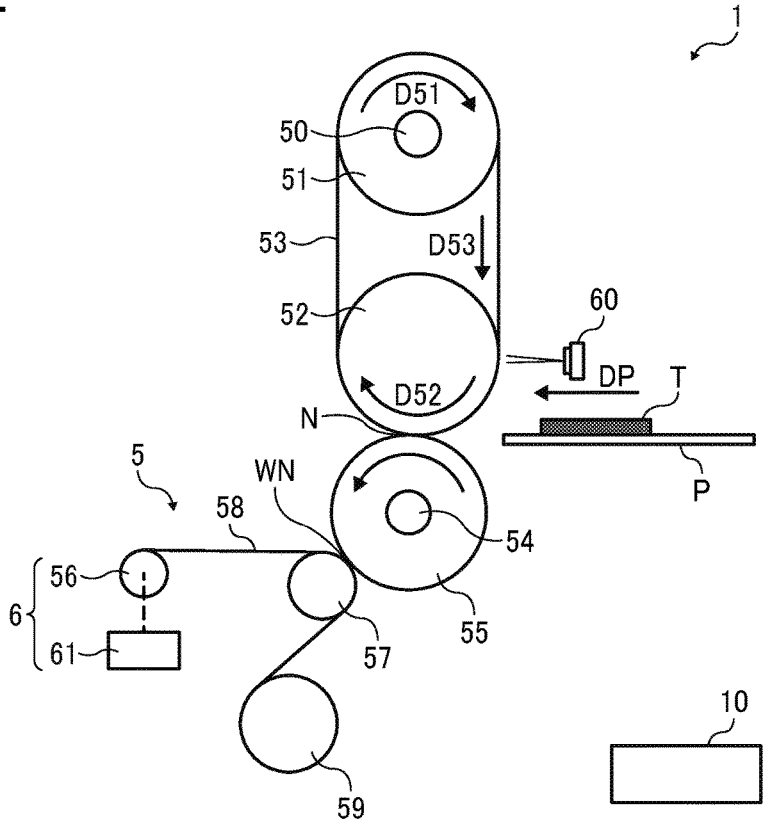
FIG. 2 is a schematic vertical cross-sectional view of a fixing device incorporated in the image forming apparatus depicted in FIG. 1.

Referring to FIG. 2, a description is provided of a construction of the fixing device 1 according to an embodiment, which is incorporated in the image forming apparatus 100 having the construction described above.

FIG. 2 is a schematic vertical cross-sectional view of the fixing device 1.

As illustrated in FIG. 2, the fixing device 1 (e.g., a fuser or a fusing unit) includes a controller 10, a heating roller 51, a fixing roller 52, a fixing belt 53, a pressure roller 55, a cleaner 5, and a temperature sensor 60. The fixing belt 53 is stretched taut across the heating roller 51 and the fixing roller 52. The pressure roller 55 is pressed against the fixing roller 52 via the fixing belt 53 to form a fixing nip N between the pressure roller 55 and the fixing belt 53. The cleaner 5 includes a cleaning web 58. The temperature sensor 60 serves as a temperature detector that detects the temperature of the fixing belt 53. A heating roller heater 50 serving as a heater or a heat source is disposed inside the heating roller 51. A pressure roller heater 54 serving as a heater or a heat source is disposed inside the pressure roller 55. As the heating roller 51 rotates in a rotation direction D51 and the fixing roller 52 rotates in a rotation direction D52, the heating roller 51 heats the fixing belt 53 throughout the entire span in a circumferential direction, that is, a rotation direction D53, of the fixing belt 53.

As a sheet P serving as a recording medium bearing a toner image T is conveyed through the fixing nip N formed between the fixing belt 53 and the pressure roller 55 pressed against the fixing roller 52 via the fixing belt 53, the fixing belt 53 and the pressure roller 55 fix the toner image T on the sheet P under heat and pressure. A shaft of each of the heating roller 51, the fixing roller 52, and the pressure roller 55 is rotatably mounted on a frame of the fixing device 1 and is extended in a longitudinal direction of the frame of the fixing device 1. A driver that drives and rotates the heating roller 51, the fixing roller 52, and the pressure roller 55 and the like are mounted on or secured to the frame of the fixing device 1.

A separator (e.g., a separation plate and a separation claw) disposed opposite the fixing roller 52 via the fixing belt 53 or the pressure roller 55 contacts a leading edge of the sheet P as the sheet P is ejected from the fixing nip N, thus separating the sheet P from the fixing belt 53 and the pressure roller 55 and guiding the sheet P to an outside of the fixing device 1.

A detailed description is now given of a configuration of the heating roller 51.

The heating roller 51 is a thin tube made of metal, for example. The heating roller heater 50 is stationarily disposed inside the tubular heating roller 51. The heating roller heater 50 is a halogen heater, a carbon heater, or the like, for example. Both lateral ends of the heating roller heater 50 in a longitudinal direction thereof parallel to an axial direction of the heating roller 51 are mounted on or secured to the frame of the fixing device 1.

A detailed description is now given of a construction of the fixing roller 52.

The fixing roller 52, accommodating no heater, is constructed of a rigid core (e.g., a core bar) being made of metal such as iron and aluminum or the like and a thick elastic layer coating the core and being made of silicone rubber or the like.

A detailed description is now given of a construction of the fixing belt 53.

The fixing belt 53 is looped over and adhered to the fixing roller 52 and the heating roller 51. The pressure roller 55 is pressed against the fixing roller 52 via the fixing belt 53 to form the fixing nip N between the fixing belt 53 and the pressure roller 55.

The fixing belt 53 is a multi-layer endless belt constructed of a base layer, an elastic layer coating the base layer, and a release layer coating the elastic layer. For example, the base layer, having a layer thickness of about 90 micrometers, is made of polyimide (PI) resin. The elastic layer is made of silicone rubber or the like.

The elastic layer, having a layer thickness of about 200 micrometers, for example, is made of an elastic material such as silicone rubber, fluoro rubber, and silicone rubber foam. The release layer, having a layer thickness of about 20 micrometers, for example, is made of tetrafluoroethylene-perfluoroalkylvinylether copolymer (PFA), polyimide (PI), polyether imide (PEI), polyether sulfide (PES), or the like. The release layer serving as a surface layer of the fixing belt 53 facilitates separation or peeling-off of toner of the toner image T on the sheet P from the fixing belt 53.

Alternatively, the fixing belt 53 may be a polyimide belt, that is, an endless film made of heat resistant resin and having a thickness of 90 micrometers, for example. The surface layer of the fixing belt 53 is coated with an offset inhibitor such as PFA.

A detailed description is now given of a construction of the pressure roller 55.

The pressure roller 55 is a roller constructed of a core bar made of SUS304 stainless steel or the like and an elastic layer coating the core bar and being made of fluoro rubber, silicone rubber, silicone rubber foam, or the like, for example. The pressure roller heater 54 serving as a heater or a heat source is stationarily disposed inside the tubular pressure roller 55.

Each of the fixing roller 52 and the pressure roller 55 is a rubber roller disposed opposite each other. As the pressure roller 55 is pressed against the fixing roller 52 radially via the fixing belt 53, the fixing nip N is formed between the pressure roller 55 and the fixing belt 53. Pressure exerted from the pressure roller 55 to the fixing roller 52 is controlled to adjust the length of the fixing nip N in a sheet conveyance direction DP. Alternatively, when the fixing device 1 is in a standby mode or the like in which the sheet P is not conveyed through the fixing nip N, the pressure roller 55 may separate from the fixing belt 53.

A detailed description is now given of a construction of the cleaner 5.

The pressure roller 55 is disposed opposite the cleaner 5. The cleaner 5 includes the cleaning web 58, a pressing roller 57, a supplier 59, and a web driver 6. The web driver 6 includes a reel-up roller 56 and a web driving motor 61. The pressing roller 57 (e.g., an elastic sponge roller) presses the cleaning web 58 made of a chemical synthetic fiber, cellulose, or the like against the pressure roller 55. If offset toner in a minute amount accidentally adhered to the fixing belt 53 while the toner image T is fixed on the sheet P moves to the pressure roller 55, the cleaning web 58 scrapes the offset toner off the pressure roller 55.

The cleaning web 58 before use is wound around an axis of the supplier 59 that supplies the cleaning web 58. The cleaning web 58 supplied from the supplier 59 passes through a web nip WN formed between the pressing roller 57 and the pressure roller 55 and reaches the reel-up roller 56. The web driving motor 61 serves as a driver that drives and rotates the reel-up roller 56. As the web driving motor 61 drives the reel-up roller 56 to reel up the cleaning web 58 at a predetermined time, an unused portion of the cleaning web 58 is supplied from the supplier 59.

According to this embodiment, the cleaner 5 is disposed opposite the pressure roller 55 and the pressing roller 57 presses the cleaning web 58 against the pressure roller 55. Alternatively, the cleaner 5 may be disposed opposite the fixing belt 53 and the cleaning web 58 may be pressed against the fixing belt 53. The cleaner 5 may have a construction other than the construction depicted in FIG. 2 as long as the cleaning web 58 contacts a cleaned member or a cleaning target and a contact portion of the cleaning web 58, which contacts the cleaned member or the cleaning target, changes.

A detailed description is now given of a configuration of the heating roller heater 50.

A power supply (e.g., an alternating current power supply) located inside the image forming apparatus 100 depicted in FIG. 1 controls output of the heating roller heater 50. The heating roller heater 50 heats the heating roller 51 with radiant heat. The heating roller 51 heats the fixing belt 53 which in turn heats the sheet P bearing the unfixed toner image T while the sheet P contacts an outer circumferential surface of the fixing belt 53. Similarly, the power supply (e.g., the alternating current power supply) located inside the image forming apparatus 100 depicted in FIG. 1 controls output of the pressure roller heater 54. The pressure roller heater 54 heats the pressure roller 55 with radiant heat.

Output of the heating roller heater 50 and the pressure roller heater 54 is controlled based on the temperature of the outer circumferential surface of the fixing belt 53 detected by the temperature sensor 60 (e.g., a thermopile) disposed opposite the outer circumferential surface of the fixing belt 53 at an arbitrary position thereon with or without an interval between the fixing belt 53 and the temperature sensor 60. That is, the temperature sensor 60 contacts or does not contact the fixing belt 53. According to this embodiment, the temperature sensor 60 is disposed opposite the fixing roller 52 such that the temperature sensor 60 does not contact the fixing belt 53. The position of the temperature sensor 60 disposed in the fixing device 1 is not limited to the position illustrated in FIG. 2. Alternatively, the temperature sensor 60 may be disposed at a position other than the position depicted in FIG. 2. For example, a temperature sensor may be disposed opposite an outer circumferential surface of the pressure roller 55 at an arbitrary position thereon with or without an interval between the pressure roller 55 and the temperature sensor. Output of the pressure roller heater 54 may be controlled based on the temperature of the outer circumferential surface of the pressure roller 55 detected by the temperature sensor.

Figure 3:
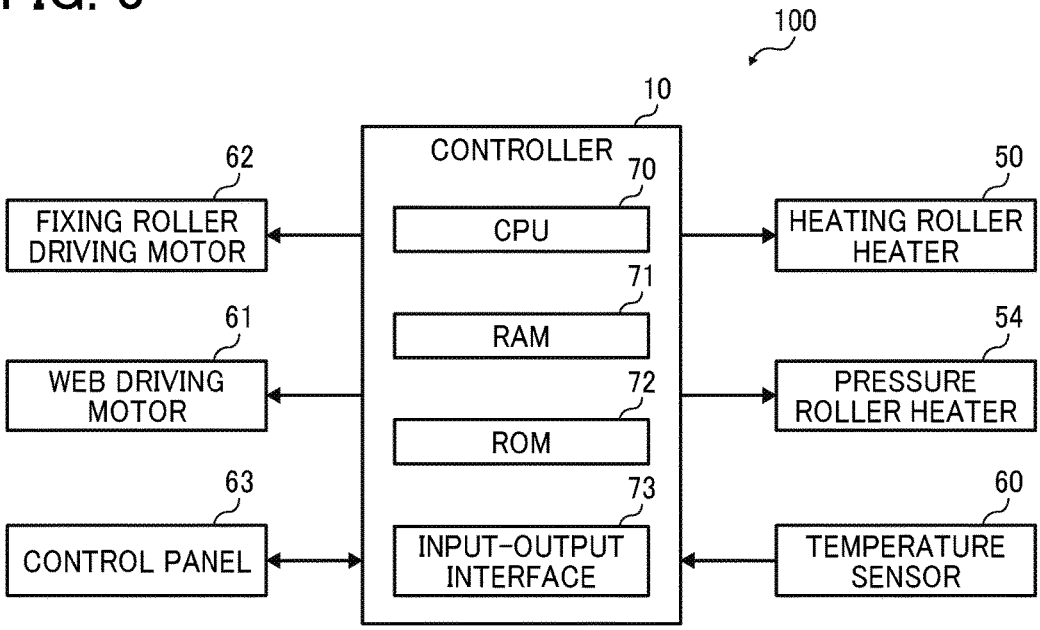
FIG. 3 is a block diagram of the image forming apparatus depicted in FIG. 1, illustrating a controller incorporated therein.

FIG. 3 is a block diagram of the image forming apparatus 100 and the fixing device 1 incorporated therein. The controller 10 may be located in the fixing device 1 or the image forming apparatus 100. For example, the controller 10 may be a controller that controls the fixing device 1 or a controller that controls the image forming apparatus 100 and the fixing device 1.

For example, the controller 10 includes a central processing unit (CPU) 70 serving as a calculator, a random-access memory (RAM) 71 and a read-only memory (ROM) 72 serving as a memory, and an input-output (I/O) interface 73, which are connected through a bus.

The controller 10 controls a fixing roller driving motor 62 to control driving of the fixing belt 53. For example, the fixing roller driving motor 62 is, but not limited to, a motor that drives and rotates the fixing roller 52. The controller 10 controls the web driving motor 61 that drives the reel-up roller 56 to reel up the cleaning web 58 serving as a cleaner that cleans the pressure roller 55. The controller 10 controls each of the heating roller heater 50 and the pressure roller heater 54 based on the temperature of the fixing belt 53 detected by the temperature sensor 60. Further, the controller 10 controls each of components of the image forming apparatus 100 and the fixing device 1 as the controller 10 receives an instruction input by a user with a control panel 63 and controls a display of the control panel 63.

A method for storing necessary information into each memory (e.g., the RAM 71 and ROM 72) is not limited. For example, the RAM 71 temporarily stores a usage rate of the cleaning web 58, a cumulative value of a temperature maintenance and rotation described below, a cumulative value (e.g., a cumulative count) of a standby mode cleaning, and the like. The ROM 72 stores a driving time (e.g., a driving time table) of the web driving motor 61 with respect to the usage rate of the cleaning web 58, a parameter of a proportional-integral-derivative (PID) controller, a target temperature, a threshold to determine whether or not to perform a temperature maintenance and rotation control described below, a threshold Sa of the standby mode cleaning, thresholds Sb and Sc of the cumulative value (e.g., the cumulative count) of the standby mode cleaning, a set value, an adjustment time Rr, a minimum rotation time Tr of a temperature maintenance and rotation control time, a set value, an adjustment time Re, and a minimum transition time Te of an energy saver mode transition time, and the like.

A description is provided of a construction of a first comparative fixing device employing a belt fixing system.

The first comparative fixing device includes a pressure roller, a fixing roller disposed opposite the pressure roller, a heating roller accommodating a heater, and an endless fixing belt stretched taut across the fixing roller and the heating roller. As a recording medium bearing an unfixed toner image is conveyed through a fixing nip formed between the fixing belt and the pressure roller, the heating roller conducts heat to the recording medium through the fixing belt, thus fixing the toner image on the recording medium under heat and pressure.

Toner of the toner image may fail to be fixed on the recording medium and may move to the fixing belt or the pressure roller. The first comparative fixing device may include a cleaner including a cleaning web that is sheet shaped. A part of the cleaning web presses against the fixing belt or the pressure roller to clean the fixing belt or the pressure roller. While the recording medium is conveyed through the first comparative fixing device, a portion of the cleaning web that contacts the fixing belt or the pressure roller changes periodically to retain cleaning performance of the cleaning web. The fixing belt or the pressure roller contacted by the cleaning web is hereinafter referred to as a cleaning target.

In the first comparative fixing device employing the belt fixing system, the fixing roller does not accommodate a heater. Accordingly, while no recording medium is conveyed through the first comparative fixing device in a standby mode or the like in which the first comparative fixing device waits for a print job, if the fixing roller halts continuously, the fixing roller may dissipate heat spontaneously and suffer from temperature decrease. Even if the heating roller heats the fixing belt, the fixing roller may absorb heat from the fixing belt, causing the fixing belt to suffer from temperature decrease and to fail to retain a predetermined fixing temperature. Consequently, the first comparative fixing device need to warm up the fixing belt. In order to prevent excessive temperature decrease of the fixing belt, the first comparative fixing device performs a temperature maintenance and rotation control to drive the fixing roller and heat the fixing belt periodically even in the standby mode so that the first comparative fixing device is ready to start a print job immediately.

However, while the temperature maintenance and rotation control is performed, the cleaning web that presses against the cleaning target may slide over a surface of the cleaning target, generating abrasion powder. If the standby mode continues for an extended period of time, the abrasion powder may accumulate on a web nip formed between the cleaning target and the cleaning web. If the abrasion powder in a predetermined amount or more accumulates on the web nip, the abrasion powder may slip through the web nip and stain the cleaning target. When a recording medium is conveyed over the cleaning target, the abrasion powder may be transferred from the cleaning target to the recording medium, resulting in formation of a faulty toner image on the recording medium.

To address this circumstance, a second comparative fixing device includes a separator that separates the cleaning web from the cleaning target. When no recording medium is conveyed over the cleaning target, the separator separates the cleaning web from the cleaning target.

However, the separator may complicate a cleaner that incorporates the separator, increasing manufacturing costs of the cleaner.

A description is provided of one example of the temperature maintenance and rotation control according to a first embodiment, which is performed by the fixing device 1.

Figure 4:
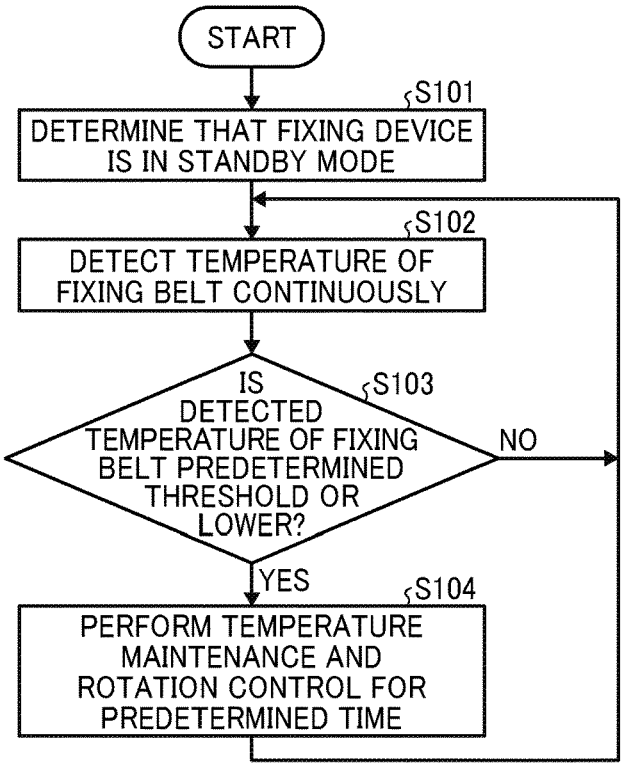
FIG. 4 is a flowchart illustrating processes of a temperature maintenance and rotation control according to a first embodiment performed by the controller depicted in FIG. 3.

FIG. 4 is a flowchart illustrating processes of the temperature maintenance and rotation control according to the first embodiment.

In step S101, the controller 10 determines that the fixing device 1 is in the standby mode in which the fixing device 1 waits for a print job and therefore no sheet P is conveyed through the fixing device 1, for example.

In step S102, the temperature sensor 60 detects the temperature of the outer circumferential surface of the fixing belt 53 looped over the fixing roller 52 continuously.

In step S103, the controller 10 determines whether or not the detected temperature of the fixing belt 53 is a predetermined threshold (e.g., 100 degrees centigrade) or lower. If the controller 10 determines that the detected temperature of the fixing belt 53 is the predetermined threshold or lower (YES in step S103), the controller 10 performs the temperature maintenance and rotation control for a predetermined time (e.g., 30 seconds) in step S104.

After the controller 10 performs the temperature maintenance and rotation control, the controller 10 returns to step S102.

Under the temperature maintenance and rotation control, the controller 10 drives the heating roller 51, the fixing roller 52, the pressure roller 55, and the fixing belt 53 while the controller 10 turns on the heating roller heater 50. The controller 10 controls and turns on the heating roller heater 50 by the PID controller based on the temperature of the fixing belt 53 detected by the temperature sensor 60 or other temperature sensor such that the fixing belt 53 maintains a predetermined temperature (e.g., 160 degrees centigrade).

Under the temperature maintenance and rotation control, the heating roller heater 50 heats the fixing roller 52 through the heating roller 51 and the fixing belt 53 so that the fixing roller 52 maintains an appropriate temperature or higher.

However, under the temperature maintenance and rotation control depicted in FIG. 4, while the controller 10 drives and rotates the fixing roller 52 that rotates the fixing belt 53, the cleaning web 58 that presses against the cleaning target (e.g., the pressure roller 55) may slide over a surface of the cleaning target, generating abrasion powder. If the abrasion powder accumulates on the web nip WN, the abrasion powder may stain the cleaning target.

To address this circumstance, a fixing device according to this embodiment (e.g., the fixing device 1) includes a fixing roller (e.g., the fixing roller 52), a heater (e.g., the heating roller heater 50), a heating roller (e.g., the heating roller 51), a fixing belt (e.g., the fixing belt 53), a pressure roller (e.g., the pressure roller 55), a cleaning web (e.g., the cleaning web 58), a web driver (e.g., the web driver 6 including the reel-up roller 56 and the web driving motor 61), a controller (e.g., the controller 10), and a fixing rotator driver (e.g., the fixing roller driving motor 62).

The heater heats the heating roller. The fixing belt serving as a fixing rotator is stretched taut across at least the fixing roller and the heating roller. The pressure roller is pressed against the fixing roller via the fixing belt to form a fixing nip (e.g., the fixing nip N) between the pressure roller and the fixing belt. The cleaning web constantly contacts a cleaning target (e.g., the fixing belt or the pressure roller). The web driver displaces the cleaning web to change a contact portion of the cleaning web, which contacts the cleaning target. The controller controls the fixing rotator driver to control driving of the fixing belt and the web driver to control driving of the cleaning web. When the fixing device is in a standby mode in which the fixing belt is not driven, the controller performs a temperature maintenance and rotation control to drive the fixing belt at a predetermined time. According to an implementation status of the temperature maintenance and rotation control, the controller controls the web driver at a predetermined time to perform a standby mode cleaning control that changes the contact portion of the cleaning web, which contacts the cleaning target.

A description is provided of the standby mode cleaning control according to a first embodiment.

Figure 5:
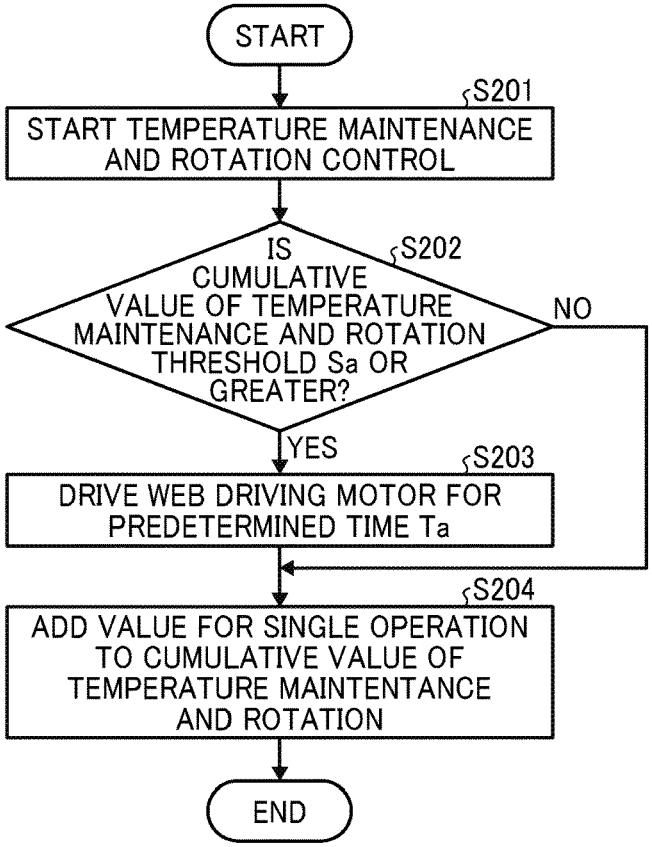
FIG. 5 is a flowchart illustrating processes of a standby mode cleaning control according to a first embodiment performed by the controller depicted in FIG. 3.

FIG. 5 is a flowchart illustrating processes of the standby mode cleaning control according to the first embodiment. As described above, the controller 10 starts the temperature maintenance and rotation control if a predetermined condition is satisfied in the standby mode in step S201.

In step S202, the controller 10 determines whether or not the cumulative value of the temperature maintenance and rotation is the threshold Sa of the standby mode cleaning or greater.

For example, the cumulative value of the temperature maintenance and rotation is a cumulative value of a driving time under the temperature maintenance and rotation control (e.g., the driving time of the web driving motor 61). Alternatively, the cumulative value of the temperature maintenance and rotation may be a cumulative value of a driving amount under the temperature maintenance and rotation control (e.g., a driving amount of the web driving motor 61). The threshold Sa of the standby mode cleaning is preset and changeable arbitrarily with an input device or the like such as the control panel 63 of the image forming apparatus 100.

If the controller 10 determines that the cumulative value of the temperature maintenance and rotation is the threshold Sa of the standby mode cleaning or greater (YES in step S202), the controller 10 drives the web driving motor 61 for a predetermined time Ta [second] to cause the reel-up roller 56 to reel up the cleaning web 58 in step S203. Step S203 is defined as the standby mode cleaning.

In step S204, the controller 10 adds a value for a single operation of the current standby mode cleaning to the cumulative value of the temperature maintenance and rotation. For example, if the cumulative value of the temperature maintenance and rotation is the cumulative value of the driving time of the web driving motor 61, the controller 10 adds 30 seconds to the cumulative value of the temperature maintenance and rotation.

If the controller 10 determines that the cumulative value of the temperature maintenance and rotation is smaller than the threshold Sa of the standby mode cleaning (NO in step S202), the controller 10 does not perform the standby mode cleaning and adds the value for the single current standby mode cleaning to the cumulative value of the temperature maintenance and rotation in step S204.

Under the standby mode cleaning control according to the first embodiment, the controller 10 counts the cumulative value of the driving time and the driving amount of the web driving motor 61 under the temperature maintenance and rotation control. If the counted cumulative value is a predetermined value or greater, the controller 10 performs the standby mode cleaning to reel up the cleaning web 58. Accordingly, the controller 10 prevents formation of a faulty toner image caused by sliding of the cleaning web 58 over the cleaning target, thus retaining quality of the toner image T formed on the sheet P. Since the fixing device 1 need not incorporate a separator that separates the cleaning web 58 from the cleaning target, the fixing device 1 retains quality of the toner image T formed on the sheet P with a simple structure manufactured at reduced costs.

A description is provided of the standby mode cleaning control according to a second embodiment.

The following describes the standby mode cleaning control according to other embodiments, which is performed by the fixing device 1. A description of details of the standby mode cleaning according to the second embodiment that are identical to the details of the standby mode cleaning according to the first embodiment described above is omitted properly.

A description is provided of reeling of the cleaning web 58 during printing (hereinafter referred to as cleaning during printing) and a cleaning time of the standby mode cleaning described above under the standby mode cleaning control according to the second embodiment.

When printing is repeated, offset toner in a minute amount may be collected by the cleaning web 58. When an amount of the offset toner exceeds an allowable value, the offset toner may slip through the cleaning web 58, staining the sheet P. Accordingly, whenever a predetermined time elapses during printing, the reel-up roller 56 reels up the cleaning web 58, thus performing a print mode cleaning that refreshes a contact face, that is, the contact portion, of the cleaning web 58 that comes into contact with the pressure roller 55.

The diameter of the reel-up roller 56 varies between an initial phase when a residual amount of the supplier 59 that supplies the cleaning web 58 is great and a terminal phase when the residual amount of the supplier 59 is small. For example, the diameter of the reel-up roller 56 in the terminal phase is greater than that in the initial phase because the reel-up roller 56 has reeled up a substantial amount of the cleaning web 58 in the terminal phase. Hence, if the number of rotations of the web driving motor 61 is constant, the reel-up roller 56 reels up the cleaning web 58 in the terminal phase in an amount greater than an amount of the cleaning web 58 reeled up in the initial phase.

Accordingly, in the print mode cleaning, the controller 10 controls the web driving motor 61 such that the driving time of the web driving motor 61 decreases gradually from the initial phase to the terminal phase, thus adjusting a reel-up amount of the cleaning web 58 reeled up by the reel-up roller 56 to a desired reel-up amount (e.g., a reel-up amount W1).

Conversely, in the standby mode cleaning, the cleaning web 58 collects abrasion powder, that is, fine particles, which might slip through the cleaning web 58 more easily than offset toner produced as toner particles are melted during printing and adhered to each other. To address this circumstance, the controller 10 controls the reel-up roller 56 to reel up the cleaning web 58 such that a reel-up amount W2 is greater than the reel-up amount W1.

In order to set an upper limit of the reel-up amount W2 in the standby mode cleaning appropriately, when the web nip WN formed between the pressing roller 57 and the pressure roller 55 has a length W3 in the sheet conveyance direction DP, the reel-up amount per one time of reeling is added to the length W3 as a margin to define a formula (1) below.

$$W2 \leq W3 + W1 \quad (1)$$

Accordingly, the reel-up roller 56 refreshes the contact face, that is, the contact portion, of the cleaning web 58, which contacts the pressure roller 55. Additionally, since the contact face of the cleaning web 58, that contacts the pressure roller 55, is new, even if the reel-up roller 56 reels up the cleaning web 58 for a length not smaller than a length corresponding to a combination of the length W3 and the reel-up amount W1, an efficiency in preventing formation of a faulty toner image is small. To address this circumstance, the combination of the length W3 and the reel-up amount W1 is defined as the upper limit, preventing waste of the cleaning web 58.

Under the standby mode cleaning control according to the second embodiment, the driving time or the driving amount of the web driving motor 61 in the standby mode cleaning is greater than the driving time or the driving amount of the web driving motor 61 in the print mode cleaning. Accordingly, the controller 10 causes the reel-up roller 56 to refresh the contact face of the cleaning web 58 adhered with fine abrasion powder precisely, thus preventing the abrasion powder from producing a faulty toner image.

A description is provided of the standby mode cleaning control according to a third embodiment.

Figure 6:
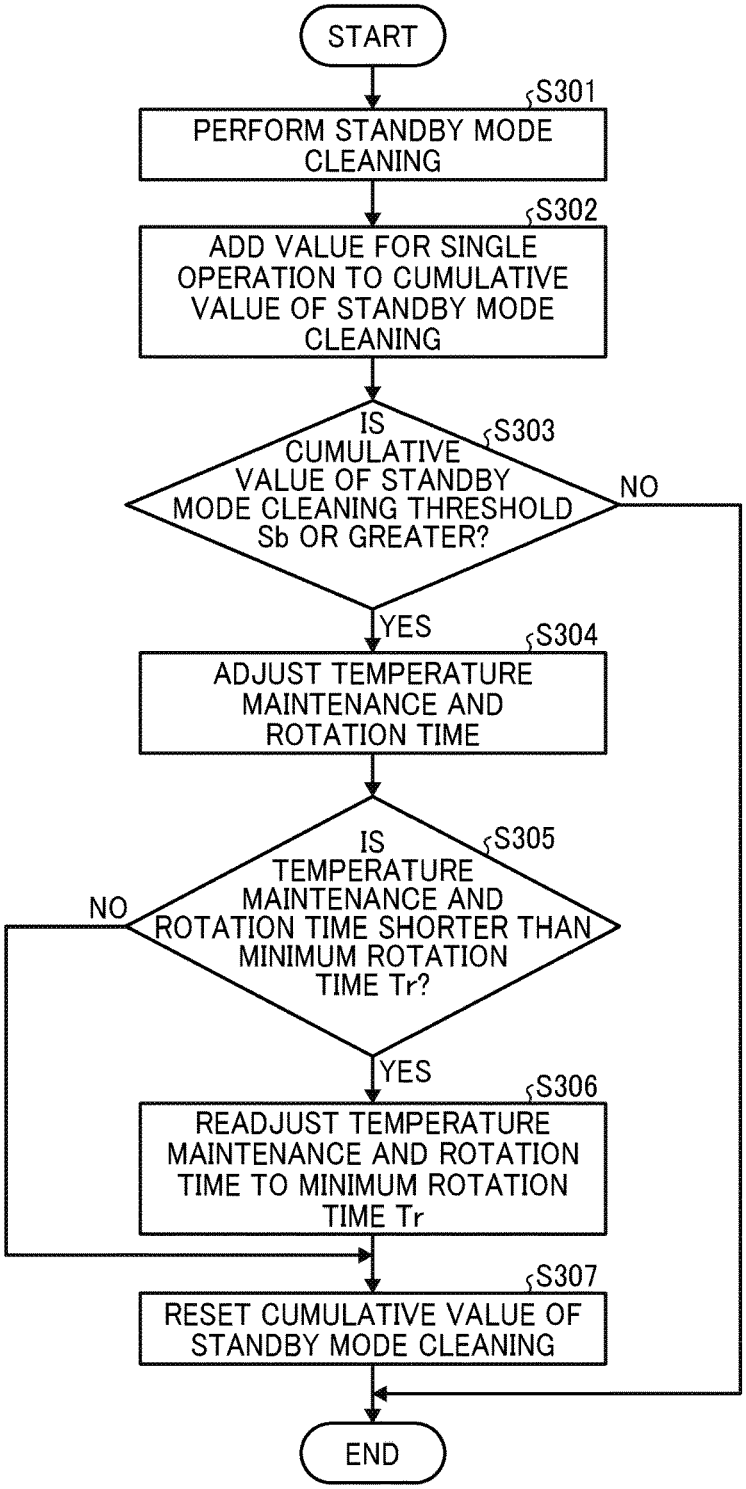
FIG. 6 is a flowchart illustrating processes of the standby mode cleaning control according to a third embodiment performed by the controller depicted in FIG. 3.

FIG. 6 is a flowchart illustrating processes of the standby mode cleaning control according to the third embodiment.

In step S301, the controller 10 performs the standby mode cleaning described above in step S203 depicted in FIG. 5.

In step S302, the controller 10 adds information (e.g., a value) for a single operation of the standby mode cleaning to the cumulative value of the standby mode cleaning. The information for the single operation is the number of implementations of the standby mode cleaning, the driving time of the web driving motor 61, the driving amount of the web driving motor 61, or the like. According to this embodiment, the number of implementations of the standby mode cleaning is used.

In step S303, the controller 10 determines whether or not the cumulative value of the standby mode cleaning is a predetermined value (e.g., the threshold Sb) or greater. If the information for the operation is the number of implementations of the standby mode cleaning, the controller 10 determines whether or not the number of implementations of the standby mode cleaning is a predetermined number or greater.

If the controller 10 determines that the cumulative value of the standby mode cleaning is the threshold Sb or greater (YES in step S303), the controller 10 defines a set value of an implementation time of the temperature maintenance and rotation control (hereinafter referred to as a temperature maintenance and rotation time) by subtracting the adjustment time Rr [second] from a current set value and adjusts the set value to be shorter than the current set value in step S304.

For example, the adjustment time Rr is 5 seconds or the like. If the current temperature maintenance and rotation time is 30 seconds, the adjusted temperature maintenance and rotation time is 25 seconds. According to this embodiment, the adjustment time Rr is subtracted from the current set value to shorten the temperature maintenance and rotation time. Alternatively, the temperature maintenance and rotation time may be shortened at a predetermined rate by multiplying the current set value by a coefficient.

Accordingly, the temperature maintenance and rotation time is shortened to decrease a sliding time when the cleaning web 58 slides over the pressure roller 55, thus reducing abrasion of the pressure roller 55.

After adjustment of the temperature maintenance and rotation time, the controller 10 determines whether or not the adjusted temperature maintenance and rotation time is shorter than the minimum rotation time Tr of the fixing roller 52 under the temperature maintenance and rotation control in step S305. The minimum rotation time Tr is a minimum rotation time required to retain the fixing roller 52 at an appropriate temperature under the temperature maintenance and rotation control.

If the controller 10 determines that the adjusted temperature maintenance and rotation time is shorter than the minimum rotation time Tr (YES in step S305), the controller 10 readjusts the temperature maintenance and rotation time to the minimum rotation time Tr in step S306.

If the controller 10 determines that the adjusted temperature maintenance and rotation time exceeds the minimum rotation time Tr (NO in step S305) or after the controller 10 readjusts the temperature maintenance and rotation time to the minimum rotation time Tr in step S306, the controller 10 resets the cumulative value of the standby mode cleaning in step S307.

Conversely, if the controller 10 determines that the cumulative value of the standby mode cleaning is smaller than the threshold Sb (NO in step S303), the controller 10 finishes the standby mode cleaning control. The various set values such as the adjustment time Rr and the threshold Sb may be changed arbitrarily with the input device or the like such as the control panel 63 of the image forming apparatus 100.

According to the third embodiment, if the controller 10 detects an operation condition that the standby mode cleaning is implemented successively, that is, if the controller 10 detects an operation condition that the fixing device 1 is in the standby mode for a long time, the controller 10 shortens the temperature maintenance and rotation time. Accordingly, before satisfaction of a condition that the cumulative value of the standby mode cleaning is the threshold Sb or greater, if the reel-up roller 56 reels up the cleaning web 58 during printing, the controller 10 resets the cumulative value of the standby mode cleaning.

Under the standby mode cleaning control according to the third embodiment, if the controller 10 detects the operation condition that the standby mode cleaning is implemented successively, the controller 10 adjusts the driving time or the driving amount under the temperature maintenance and rotation control to be smaller than the current value, thus shortening the sliding time when the cleaning web 58 slides over the cleaning target (e.g., the pressure roller 55), reducing abrasion of the cleaning target, and thereby suppressing formation of a faulty toner image. Additionally, the controller 10 suppresses the frequency of the standby mode cleaning, extending the life of the cleaning web 58, reducing maintenance costs for replacing the cleaning web 58, and saving resources.

A description is provided of the standby mode cleaning control according to a fourth embodiment.

Figure 7:
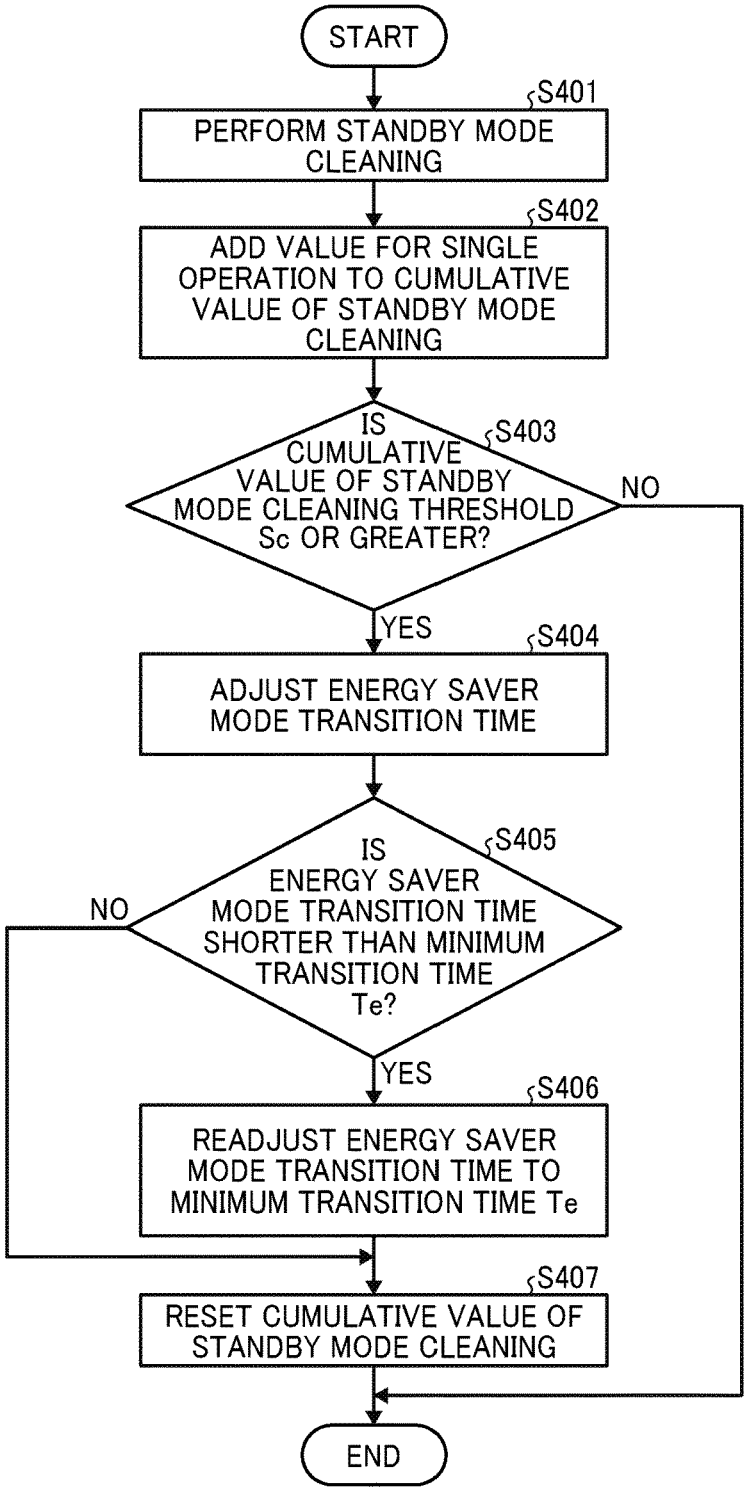
FIG. 7 is a flowchart illustrating processes of the standby mode cleaning control according to a fourth embodiment performed by the controller depicted in FIG. 3.

FIG. 7 is a flowchart illustrating processes of the standby mode cleaning control according to the fourth embodiment.

In step S401, the controller 10 performs the standby mode cleaning described above in step S203 depicted in FIG. 5.

In step S402, the controller 10 adds information (e.g., a value) for a single operation of the standby mode cleaning to the cumulative value of the standby mode cleaning. For example, the information for the single operation is the number of implementations of the standby mode cleaning, the driving time of the web driving motor 61, the driving amount of the web driving motor 61, or the like. According to this embodiment, the number of implementations of the standby mode cleaning is used as an example.

In step S403, the controller 10 determines whether or not the cumulative value of the standby mode cleaning is a predetermined value (e.g., the threshold Sc) or greater.

If the information for the operation is the number of implementations of the standby mode cleaning, the controller 10 determines whether or not the number of implementations of the standby mode cleaning is a predetermined number or greater.

If the controller 10 determines that the cumulative value of the standby mode cleaning is the threshold Sc or greater (YES in step S403), the controller 10 defines the set value of the energy saver mode transition time by subtracting the adjustment time Re [second] from a current set value and adjusts the set value to be shorter than the current set value in step S404.

The energy saver mode defines a state in which the controller 10 suppresses power consumption of the fixing device 1 to reduce power consumption of the image forming apparatus 100. The controller 10 does not perform the temperature maintenance and rotation control in the energy saver mode. For example, the adjustment time Re is 15 minutes or the like. If the current energy saver mode transition time is 60 minutes, the adjusted energy saver mode transition time is 45 minutes. According to this embodiment, the adjustment time Re is subtracted from the current set value to shorten the energy saver mode transition time. Alternatively, the energy saver mode transition time may be shortened at a predetermined rate by multiplying the current set value by a coefficient.

Accordingly, the energy saver mode transition time is shortened to decrease the sliding time when the cleaning web 58 slides over the pressure roller 55, thus reducing abrasion of the pressure roller 55.

After adjustment of the energy saver mode transition time, the controller 10 determines whether or not the adjusted energy saver mode transition time is shorter than the minimum transition time Te in step S405.

The minimum transition time Te is a time long enough to prevent formation of a faulty toner image due to abrasion powder precisely and a longest time that is set to improve usability for the user. For example, the energy saver mode transition time of 1 minute prevents formation of a faulty toner image but causes the fixing device 1 to enter the energy saver mode frequently. Accordingly, the fixing device 1 is warmed up every time before printing, degrading usability for the user. To address this circumstance, a longest time to prevent formation of a faulty toner image, for example, 30 minutes, is set as the minimum transition time Te.

If the controller 10 determines that the adjusted energy saver mode transition time is shorter than the minimum transition time Te (YES in step S405), the controller 10 readjusts the energy saver mode transition time to the minimum transition time Te in step S406.

If the controller 10 determines that the adjusted energy saver mode transition time exceeds the minimum transition time Te (NO in step S405) or after the controller 10 readjusts the energy saver mode transition time to the minimum transition time Te in step S406, the controller 10 resets the cumulative value of the standby mode cleaning in step S407.

Conversely, if the controller 10 determines that the cumulative value of the standby mode cleaning is smaller than the threshold Sc (NO in step S403), the controller 10 finishes the standby mode cleaning control.

The various set values such as the adjustment time Re and the threshold Sc may be changed arbitrarily with the input device or the like such as the control panel 63 of the image forming apparatus 100.

According to the fourth embodiment, if the controller 10 detects an operation condition that the standby mode cleaning is implemented successively, that is, if the controller 10 detects an operation condition that the fixing device 1 is in the standby mode for a long time, the controller 10 shortens the energy saver mode transition time to prevent the fixing device 1 from being in the standby mode for a long time. Accordingly, before satisfaction of a condition that the cumulative value of the standby mode cleaning is the threshold Sc or greater, if the reel-up roller 56 reels up the cleaning web 58 during printing, the controller 10 resets the cumulative value of the standby mode cleaning.

Since users set the energy saver mode transition time arbitrarily, there may be a user who does not wish to change the energy saver mode transition time. To address this circumstance, the user instructs the controller 10 to determine whether or not to adjust the energy saver mode transition time with the control panel 63. Alternatively, if the controller 10 is ready to change the set value when an adjustment condition for adjusting the energy saver mode transition time is satisfied, the controller 10 may display a confirmation message on the control panel 63. The confirmation message requests the user to determine whether or not to change the energy saver mode transition time. Yet alternatively, the controller 10 may perform the standby mode cleaning control according to the fourth embodiment together with the standby mode cleaning control according to the third embodiment.

Under the standby mode cleaning control according to the fourth embodiment, if the controller 10 detects the operation condition that the standby mode cleaning is implemented successively, the controller 10 adjusts the energy saver mode transition time to be shorter than the current value, thus decreasing the frequency of implementation of the temperature maintenance and rotation control, reducing abrasion of the cleaning target, and thereby suppressing formation of a faulty toner image. Additionally, the controller 10 suppresses the frequency of the standby mode cleaning, extending the life of the cleaning web 58, reducing maintenance costs for replacing the cleaning web 58, and saving resources.

A description is provided of the temperature maintenance and rotation control according to a second embodiment.

Under the temperature maintenance and rotation control depicted in FIG. 4, the temperature sensor 60 detects the temperature of the outer circumferential surface of the fixing belt 53 looped over the fixing roller 52 continuously. If the controller 10 determines that the detected temperature of the fixing belt 53 is the predetermined threshold or lower, the controller 10 performs the temperature maintenance and rotation control.

Figure 8:
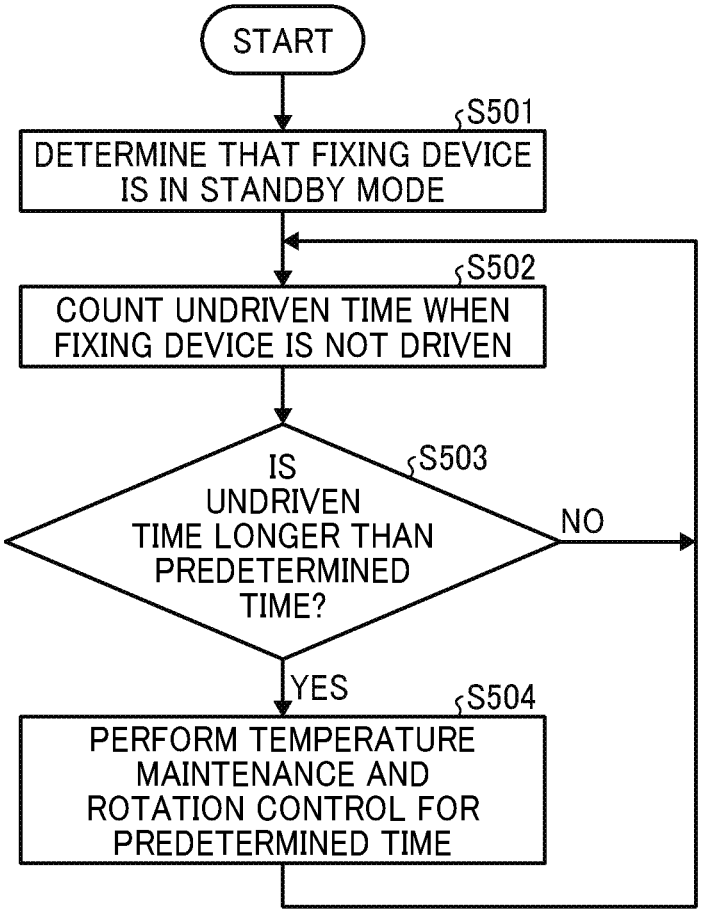
FIG. 8 is a flowchart illustrating processes of the temperature maintenance and rotation control according to a second embodiment performed by the controller depicted in FIG. 3.

Referring to FIG. 8, a description is provided of the temperature maintenance and rotation control according to the second embodiment as a variation of the temperature maintenance and rotation control depicted in FIG. 4.

FIG. 8 is a flowchart illustrating processes of the temperature maintenance and rotation control according to the second embodiment.

In step S501, the controller 10 determines that the fixing device 1 is in the standby mode when no sheet P is conveyed through the fixing device 1, for example.

In step S502, the controller 10 counts an undriven time when the fixing device 1 is not driven.

In step S503, the controller 10 determines whether or not the undriven time of the fixing device 1 is longer than a predetermined time (e.g., 300 seconds).

If the controller 10 determines that the undriven time of the fixing device 1 is longer than the predetermined time (YES in step S503), the controller 10 performs the temperature maintenance and rotation control for a predetermined time (e.g., 30 seconds) in step S504.

After the controller 10 performs the temperature maintenance and rotation control, the controller 10 returns to step S502.

The controller 10 performs the temperature maintenance and rotation control and controls turning on of the heating roller heater 50 during the temperature maintenance and rotation control similarly to the first embodiment depicted in FIG. 4. The user changes the threshold (e.g., 300 seconds) of the undriven time based on which the controller 10 determines to start the temperature maintenance and rotation control and the temperature maintenance and rotation time (e.g., 30 seconds) with the control panel 63 or the like. The fixing device 1 may employ the temperature maintenance and rotation control according to the first embodiment depicted in FIG. 4 or the temperature maintenance and rotation control according to the second embodiment depicted in FIG. 8 in view of the standby mode cleaning control according to the first to fourth embodiments described above.

Under the temperature maintenance and rotation control according to the second embodiment, the controller 10 counts the undriven time when the fixing device 1 is not driven and performs the temperature maintenance and rotation control based on a cumulative time of the counted undriven time, thus retaining the temperature of the fixing roller 52 at a desired temperature or higher.

A description is provided of advantages of the fixing device 1.

As illustrated in FIGS. 2 and 3, a fixing device (e.g., the fixing device 1) includes a fixing roller (e.g., the fixing roller 52), a heating roller (e.g., the heating roller 51), a heater (e.g., the heating roller heater 50), a fixing rotator (e.g., the fixing belt 53), a pressure rotator (e.g., the pressure roller 55), a cleaning web (e.g., the cleaning web 58), a web driver (e.g., the web driver 6), a controller (e.g., the controller 10), and a fixing rotator driver (e.g., the fixing roller driving motor 62).

The heater heats the heating roller. The fixing rotator is a fixing belt stretched taut across at least the fixing roller and the heating roller. The pressure rotator is pressed against the fixing roller via the fixing belt to form a fixing nip (e.g., the fixing nip N) between the pressure rotator and the fixing belt. The cleaning web constantly contacts a cleaning target (e.g., the fixing belt or the pressure rotator). The web driver displaces the cleaning web to change a contact portion of the cleaning web, which contacts the cleaning target. The controller controls the fixing rotator driver to control driving of the fixing rotator (e.g., the fixing belt or the fixing roller), the heater to control heating of the fixing rotator, and the web driver to control driving of the cleaning web. When the fixing device is in a standby mode in which the fixing rotator is not driven and no recording medium is conveyed through the fixing nip, the controller controls the heater and the fixing rotator driver to perform a temperature maintenance and rotation control to heat and rotate the fixing rotator at a predetermined time. According to an implementation status of the temperature maintenance and rotation control, the controller controls the web driver at a predetermined time to perform a standby mode cleaning control that changes the contact portion of the cleaning web, which contacts the cleaning target.

Accordingly, the fixing device retains high quality of a toner image (e.g., a toner image T) formed on a recording medium (e.g., a sheet P) with a simple structure.

According to the embodiments described above, the fixing belt 53 serves as a fixing rotator. Alternatively, a fixing roller, a fixing film, or the like may be used as a fixing rotator. Further, the pressure roller 55 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing rotator;

a heater configured to heat the fixing rotator;

a pressure rotator configured to press against the fixing rotator to form a fixing nip between the pressure rotator and the fixing rotator, the fixing nip through which a recording medium bearing a toner image is conveyed;

a cleaning web configured to contact one of the fixing rotator and the pressure rotator, to clean the one of the fixing rotator and the pressure rotator;

a web driver configured to displace the cleaning web to change a contact portion of the cleaning web, which contacts the one of the fixing rotator and the pressure rotator;

a fixing rotator driver configured to drive and rotate the fixing rotator; and a controller configured to, control the heater and the fixing rotator driver to perform a temperature maintenance and rotation control to heat and rotate the fixing rotator when the fixing device is in a standby mode in which the recording medium is not conveyed through the fixing nip, determine, while performing the temperature maintenance and rotation control, whether a driving time and a driving amount of the web driver exceeds a threshold, and control the web driver to perform a standby mode cleaning control to change the contact portion of the cleaning web in response to the driving time and the driving amount of the web driver during the temperature maintenance and rotation control exceeding the threshold, and to maintain the contact portion of the cleaning web in response to the driving time and the driving amount of the web driver during the temperature maintenance and rotation control not exceeding the threshold.

2. The fixing device according to claim 1, wherein the controller adjusts one of the driving time and the driving amount of the web driver under the standby mode cleaning control in the standby mode to be greater than one of the driving time and the driving amount of the web driver in a print mode in which the recording medium is conveyed through the fixing nip.

3. The fixing device according to claim 1, wherein the controller decreases one of the driving time and the driving amount of the web driver under the temperature maintenance and rotation control under a predetermined condition if the controller performs the standby mode cleaning control successively while the recording medium is not conveyed through the fixing nip.

4. The fixing device according to claim 1, wherein the controller shortens an energy saver mode transition time under a predetermined condition if the controller performs the standby mode cleaning control successively while the recording medium is not conveyed through the fixing nip.

5. The fixing device according to claim 1, further comprising:

a temperature detector, opposite the fixing rotator, the temperature detector configured to detect a temperature of the fixing rotator.

6. The fixing device according to claim 5, wherein the temperature detector is opposite the fixing rotator with an interval between the temperature detector and the fixing rotator.

7. The fixing device according to claim 5, wherein the temperature detector contacts the fixing rotator.

8. The fixing device according to claim 5, wherein the controller is configured to determine whether or not to perform the temperature maintenance and rotation control based on the temperature of the fixing rotator detected by the temperature detector.

9. The fixing device according to claim 1, wherein the controller is configured to, count an undriven time when the fixing device is not driven in the standby mode, and determine whether or not to perform the temperature maintenance and rotation control based on the undriven time.

10. The fixing device according to claim 1, wherein the web driver includes:

a reel-up roller configured to reel up the cleaning web; and a web driving motor configured to drive the reel-up roller.

11. The fixing device according to claim 1, wherein the fixing rotator includes a fixing roller.

12. The fixing device according to claim 1, wherein the fixing rotator includes a fixing belt.

13. The fixing device according to claim 12, further comprising:

a fixing roller; and a heating roller heated by the heater, wherein the fixing belt is stretched taut across at least the fixing roller and the heating roller.

14. The fixing device according to claim 13, further comprising:

a temperature detector, opposite the fixing roller via the fixing belt, the temperature detector configured to detect a temperature of the fixing belt.

15. An image forming apparatus comprising:

an image bearer configured to bear a toner image;

a fixing device configured to fix the toner image on a recording medium, the fixing device including:

a fixing rotator;

a heater configured to heat the fixing rotator;

a pressure rotator configured to press against the fixing rotator to form a fixing nip between the pressure rotator and the fixing rotator, the fixing nip through which the recording medium bearing the toner image is conveyed;

a cleaning web, configured to contact one of the fixing rotator and the pressure rotator, to clean the one of the fixing rotator and the pressure rotator;

a web driver configured to displace the cleaning web to change a contact portion of the cleaning web, which contacts the one of the fixing rotator and the pressure rotator; and a fixing rotator driver configured to drive and rotate the fixing rotator; and a controller configured to, control the heater and the fixing rotator driver to perform a temperature maintenance and rotation control to heat and rotate the fixing rotator when the fixing device is in a standby mode in which the recording medium is not conveyed through the fixing nip, determine, while performing the temperature maintenance and rotation control, whether a driving time and a driving amount of the web driver exceeds a threshold, and troll control the web driver to perform a standby mode cleaning control to change the contact portion of the cleaning web in response to the driving time and the driving amount of the web driver during the temperature maintenance and rotation control exceeding the threshold, and to maintain the contact portion of the cleaning web in response to the driving time and the driving amount of the web driver during the temperature maintenance and rotation control not exceeding the threshold.

16. An image forming method comprising:

starting a temperature maintenance and rotation control to heat and rotate a fixing rotator in a standby mode in which a recording medium is not conveyed over the fixing rotator;

determine, while performing the temperature maintenance and rotation control, whether a driving time and a driving amount of a web driving motor exceeds a threshold;

performing a standby mode cleaning operation to drive the web driving motor to reel up a cleaning web in response to the driving time and the driving amount of the web driving motor during the temperature maintenance and rotation control exceeding the threshold; and maintaining a contact portion of the cleaning web in response to the driving time and the driving amount of the web driving motor during the temperature maintenance and rotation control not exceeding the threshold.

17. The fixing device according to claim 1, wherein the controller is configured to control the web driver to perform the standby mode cleaning control such that a time between consecutive instances of the web driver reeling up the cleaning web during the temperature maintenance and rotation control in the standby mode varies based on the driving time and the driving amount of the web driving motor.

18. The image forming apparatus according to claim 15, wherein the controller is configured to control the web driver to perform the standby mode cleaning control such that a time between consecutive instances of the web driver reeling up the cleaning web during the temperature maintenance and rotation control in the standby mode varies based on the driving time and the driving amount of the web driving motor.

19. The image forming method according to claim 16, wherein the performing controls the web driving motor to perform the standby mode cleaning operation such that a time between consecutive instances of the web driver reeling up the cleaning web during the temperature maintenance and rotation control in the standby mode varies based on the driving time and the driving amount of the web driving motor.

* * * * *